US009080300B2

(12) United States Patent
Wang et al.

(10) Patent No.: US 9,080,300 B2
(45) Date of Patent: Jul. 14, 2015

(54) POLYMER GROUTING METHOD FOR CONSTRUCTING ULTRA-THIN ANTI-SEEPAGE WALL

(71) Applicant: Henan Polytech Infrastructure Rehabilitation LTD., Zhengzhou, Henan (CN)

(72) Inventors: Fuming Wang, Henan (CN); Mingsheng Shi, Henan (CN); Wenting Liu, Henan (CN); Yanhui Zhong, Henan (CN); Xiaoliang Wang, Henan (CN)

(73) Assignee: SAFEKEY Engineering Technology(Zhengzhou), Ltd., Zhengzhou, Henan (CN)

( * ) Notice: Subject to any disclaimer, the term of this patent is extended or adjusted under 35 U.S.C. 154(b) by 0 days.

(21) Appl. No.: 13/866,025

(22) Filed: Apr. 19, 2013

(65) Prior Publication Data

US 2014/0314498 A1 Oct. 23, 2014

(51) Int. Cl.

| | |
|---|---|
| ***E02D 3/00*** | (2006.01) |
| ***E02D 19/18*** | (2006.01) |
| ***E02D 15/04*** | (2006.01) |
| ***E02D 19/12*** | (2006.01) |
| ***E02D 19/16*** | (2006.01) |

(52) U.S. Cl.
CPC *E02D 3/00* (2013.01); *E02D 15/04* (2013.01); *E02D 19/12* (2013.01); *E02D 19/16* (2013.01); *E02D 19/18* (2013.01)

(58) Field of Classification Search
CPC ..... E02D 19/18; E02D 3/12; E02D 17/13; E02D 3/00; E02D 2250/003
USPC ..... 405/266, 267, 269, 272–280, 302.4; 222/611.1, 611.2
See application file for complete search history.

(56) References Cited

U.S. PATENT DOCUMENTS

| | | | | |
|---|---|---|---|---|
| 3,969,902 | A * | 7/1976 | Ichise et al. | 405/267 |
| 5,586,840 | A * | 12/1996 | Nishio et al. | 405/267 |
| 6,554,544 | B1 * | 4/2003 | Barkasz | 405/274 |
| 2009/0304457 | A1 * | 12/2009 | Shimada et al. | 405/269 |

FOREIGN PATENT DOCUMENTS

| | | |
|---|---|---|
| CN | 102051868 | 5/2011 |
| CN | 102051869 | 5/2011 |

* cited by examiner

*Primary Examiner* — Sunil Singh
*Assistant Examiner* — Carib Oquendo

(57) ABSTRACT

A polymer grouting method for constructing an ultra-thin anti-seepage wall meeting requirements of anti-seepage designs of dams, includes the following steps of: forming continuous slots on a body of the dam and the foundation which need seepage-proofing and reinforcing; and injecting two-component expansive polymer grouting materials to the slots through grouting pipes, a volume rapidly expands after the polymer grouting materials reacts and the slots are filled to form a polymer ultra-thin body, the polymer ultra-thin bodies which are adjacent are cemented together to form a continuous, uniform, and regular cementing ultra-thin polymer anti-seepage wall; this invention is different from the conventional anti-seepage wall technology whatever through the material, the mechanism or the construction methods, which has the advantages such as speediness, ultra-thinness, minimally invasive, lightness, high toughness, economy, and durability, applied in reinforcement projects of a number of the dams and dikes.

3 Claims, 6 Drawing Sheets

POLYMER GROUTING METHOD FOR CONSTRUCTING ULTRA-THIN ANTI-SEEPAGE WALL

BACKGROUND OF THE PRESENT INVENTION

1. Field of Invention

The present invention belongs to an seepage-proofing and reinforcement field of infrastructures such as water conservancy, mine, and environmental protection, more particularly to a grouting method of an ultra-thin polymer anti-seepage wall related to an embankment, earth dam, tailing dam, interception-pollutant dam seepage-proofing and reinforcement.

2. Description of Related Arts

Since the founding of People's Republic of China, the water conservancy, mining, environmental protection and other infrastructures of China have made remarkable achievements, and have played important roles in China's economic development and social progress. In the field of water conservancy infrastructure, the water conservancy infrastructures are built in the '50s~'70s. Limited to the economic and technological conditions, many reservoir design and construction quality are inadequate. After long-running, the problems that long-term disrepair, serious aging and dangerousness are serious. At present, 87,000 reservoirs of various types have been built, ranking the first in the world. About 40% small-sized reservoirs and 25% medium-sized reservoirs are in danger, they are great threats to people's lives and properties, and social stability. During a long history of dam construction, the majority are formed by heightening and thickening over the years, the construction soils on the body are from different periods, the construction quality can not meet the design requirements, and thus there are different security risks. Among the over 40000 existing dangerous reservoirs in China, more than 90% are built with rock and soil, and the majority are built by soil. According to the preliminary calculations, more than 50% of the small reservoirs need seepage controlling and reinforcing. In the field of mining infrastructure, the tailings dams are the major facilities of mining beneficiating production, which are also the accident-prone parts and the source of security risks. Furthermore, there are kinds of toxic and hazardous substances in the tailings dams which are man-made stone and soil flowing area of a high potential, the safe operation is directly related to the safety of life and property of the people living at downstream and the ecological environment of the surrounding areas of the tailings dams. In the great amount of tailings dams in China, less than 70% are in normal operation currently, and more than 40% are at risky, diseased, expired services status, so catastrophic accidents occur frequently. Seepage is one of the major reasons that the tailings dams have accidents. How to effectively control the seepage for ensuring the safe operation of the tailings dams is terribly urgent and important. In the field of environmental protection infrastructure, according to statistics, in current landfills, more than 95% are simply buried and quasi sanitary landfill, since the horizontal impervious measures are not used in most landfills, and the exhaust system for the leachate at bottom is not perfect, which results in a large amounts of untreated leachate directly seeping into the soil and the groundwater to cause serious pollution to the environment. In recent years, people take more and more attention on the landfill problems, new landfills are established in many provinces. However, the quantity and scale of the landfills can not meet the requirement of the growing domestic garbage, the real innocuous disposal garbage is only 2.3%. The main problem that how to prevent the leachate seepage pollution should be considered at first. The leachate seepage pollution can be properly treated by seepage-proofing on the interception-pollutant dam, but the geographical environment and the geological condition of the most landfills can not meet the requirement of seepage-proofing.

Thus, seepage is a common problem which the water conservancy, mine, and environmental protection infrastructures such as the earth dams, the tailing dams, and the interception-pollutant dams have, the seepage-proofing and reinforcement on these infrastructures are long-term and arduous tasks we should face. The seepage-proofing technologies widely used in engineering include concrete anti-seepage wall technology, cement mixing pile technology, and jet grouting technology etc. These seepage-proofing technologies widely used in China have played an important role in the seepage-proofing and reinforcement of the infrastructures such as the large reservoirs, the tailings, and landfills, but there are still some technical deficiencies. In the field of anti-seepage wall material, conventional anti-seepage walls materials are the cement-like, wherein the anti-seepage walls constructed are rigid, which are different from the soil elastic modulus, wherein the impermeability and the crack resistance are inadequate. In the wall building mechanism, materials are easy to separated from soil, and it is hard to grout into a complete and continuous wall according to the conventional anti-seepage wall building seepage-proofing technology; In the way of construction, anti-seepage walls are formed by grooving, stirring, spraying and vibrating on the soil in the conventional anti-seepage wall building technology, the dams are badly destructed by disturbance. The problems that the unequally stirring, grout pouring, unreasonable loading, and discontinuous pile body lead to low pile strength, poor construction quality, and non-ideal seepage effect. The slurry gets great energy by the high-pressure device according to the high-pressure jet grouting technology. Thus, the anti-seepage technology widely used in the engineering has the shortcomings of large disturbance destruction, long duration, high cost, and inconvenient construction, especially to a large number of the small and medium-sized dams, the conventional technology is limited by not only the funding, but also the bulky equipment and the difficult entering, which are not adapt to the present developing demand of the anti-seepage and reinforcement technology of the dams, the tailing dams and the sewage dams. Therefore, speeding up the research of the new materials, new technology, and new equipment are the solutions of the significant science and technology problems which are met in the conventional anti-seepage and reinforcement technology of the embankments, the earth dams, the tailing dams, the interception-pollutant dams of the infrastructures such as water conservancy, mine, and environmental protection.

Polymer grouting technology is one of the foundation rapid reinforcement technologies which has developed since the 1970s. The polymer materials are injected into the foundation by the property that a volume rapidly expands after the polymer materials react to reinforce the foundation, fill the blank space, and lift the floor. At present, the polymer grouting technology is mainly used in the field of foundation reinforcement of the industrial and the civil buildings and the road maintenance. In recent years, the invention dedicates to the research and development of the dam anti-seepage polymer grouting technology with respect to the developing demand of the dam reinforcement and the deficiencies existed in the conventional dam anti-seepage technology, and has filed the patent applications having numbers of CN200910066334.8 and CN200910066335.2, creating a new way to build ultra-thin polymer anti-seepage bodies, which are, however, massive connected, and hard to form a continuous anti-seepage system.

SUMMARY OF THE PRESENT INVENTION

An object of the present invention is to provide a grouting method of an ultra-thin polymer anti-seepage wall with respect to the developing demand of the dam reinforcement and the deficiencies existed in the conventional dam anti-seepage technology. A continuous, uniform and regular cementing ultra-thin polymer anti-seepage wall is built which has excellent performance of anti-seepage effect and crack resistance according to the present invention to provide a new way which is advanced, efficient, economical, and practical to the anti-seepage technology of the dams, the tailings dams and the sewage dams.

Accordingly, in order to accomplish the above objects, the present invention provides a polymer grouting method for constructing an ultra-thin anti-seepage wall meeting requirements of anti-seepage designs of dams, the method comprises the following steps of:

forming slots which are continuous on bodies of the dams and foundations which need seepage-proofing and reinforcing; and injecting two-component expansive polymer grouting materials to the slots through grouting pipes, wherein a volume rapidly expands after the two-component expansive polymer grouting materials reacts and the slots are filled to form polymer ultra-thin bodies, the polymer ultra-thin bodies which are adjacent are cemented together to form a continuous, uniform, and regular cementing ultra-thin polymer anti-seepage wall; specifically, the method comprises the following steps of:

1) arranging the slots: arranging the slots on the bodies of the dams and the foundations which need seepage-proofing and reinforcing according to the anti-seepage design and giving the slots numbers;
2) forming the slots: forming the slots which are continuous by a slot equipment;
3) grouting into the slots, comprising:
   a. providing grouting pipes into the slots, wherein each grouting pipe is deeply inserted into each bottom of the slots; and
   b. injecting the two-component expansive polymer grouting materials into the slots through the grouting pipes, and continuously lifting the grouting pipes, in such a manner that the two-component expansive polymer grouting materials fill up the slots from bottom to top to form an ultra-thin polymer anti-seepage body; and
4) forming the ultra-thin polymer anti-seepage wall, comprising: closely cementing the ultra-thin polymer anti-seepage bodies which are adjacent together by setting the slots and dividing construction regionals to form the continuous, uniform, and closely cementing ultra-thin polymer anti-seepage wall.

In step 3) b, polymer lifting grouting control equipments are used in lifting the grouting pipes, the polymer lifting grouting control equipment comprises a rack, a first speed reducer provided on the rack, a motor connected with the first speed reducer, a main transmission shaft and a minor transmission shaft provided on the rack, wherein the main transmission shaft is connected with the first speed reducer, the minor transmission shaft is connected with the main transmission shaft through a transmission chain, a left board and a right board are provided on the rack, two active driving bevel gears are provided on the main transmission shaft and the minor transmission shaft separately, two passive driving bevel gears are provided on the left board and the right board separately which are meshing with the two active driving bevel gears, and the passive driving bevel gears connected with the right board are embedded in an inner of two bearings which are vertically connected with the right board, the active driving bevel gears meshing with the passive driving bevel gears connected with the right board are connected with the main transmission shaft and the minor transmission shaft by spline grooves and capstans, the spline grooves are provided in the inner of the passive driving bevel gears, the capstans are embedded in the main transmission shaft and the minor transmission shaft, a concave gear is provided on the other end of each of the passive driving bevel gears, a second reducer is provided on the rash, a cross-handle is connected with the second reducer, the right board is connected with the second reducer through the separation screw, an armrest is provided on the rack.

The polymer lifting grouting control equipment further comprises a manipulate box connected with the motor, wherein a voltmeter, an ammeter, a frequency converter, and a master switch are provided in the manipulate box.

The slot equipments are three cone head pressure slot board and static press-in equipment, wherein the three cone head pressure slot board comprises a middle drill pipe, a left drill pipe, and a right drill pipe, wherein the left drill pipe has a same size as the right pipe, the left drill pipe is connected with the middle drill pipe through a left-wing board, the right drill pipe is connected with the middle drill pipe through a right-wing board, the left-wing broad has a same size as the right-wing broad, wherein the middle drill pipe, the left-wing board, the right-wing board, the left drill pipe and the right drill pipe are at a same horizonal plane, wherein a lower end of the middle drill pipe is tapered, a connector is provided on an upper end, two ends of the left drill pipe and the right drill pipe are both tapered.

Compared with the conventional anti-seepage technology, the present invention has the following advantages that:

1) the disturbances to dams are small; the size of slot board of the polymer anti-seepage wall is small (wherein a diameter of the cone is 4~8 cm, a thickness of the wing is 1~3 cm), the disturbances to the dams are small through the static pressing, and the anhydrous grouting;
2) the construction is fast, which need not to wait; pressuring holes, sealing holes, grouting are continuous operation. 15 minutes after the reaction, about 90% strength is formed, which needs not to wait;
3) the cost is low; compared with other anti-seepage wall technologies, the polymer anti-seepage wall technology can save the cost of 50%.
4) the construction is convenient; the polymer grouting serialized equipments are adopt to seepage reinforcement and rescue; and
5) the durability is good. The polymer grouting material performance is stable, the flexibility is good, the polymer grouting material is closely bonded with soil, deforms coordinately, the crack resistance of the anti-seepage wall is good.

Therefore, the ultra-thin polymer anti-seepage wall technology researched and developed according to the present invention has lots of advantages in the reinforcement works such as large dams, embankments, tailings, garbage landfills. Compared with the conventional seepage-proofing and reinforcement technology, the polymer anti-seepage technology is a new technology, mainly:

1) in the aspect of anti-seepage wall material: according to the flexible anti-seepage concept, the polymer anti-seepage wall technology uses a new non-water reacted polymer grouting material, the anti-seepage wall is a flexible, the seepage and crack resistance are good;

2) in the aspect of wall building mechanism, the polymer anti-seepage wall technology uses the expansion of the material, the slurry penetrates into the tiny pores of the surrounding soil to form a cementation layer, and 3) in the aspect of the way of construction, the polymer anti-seepage wall technology is that by forming ultra-thin slots through static pressing, whose width is 50~120 cm, and thickness is 1~3 cm, the ultra-thin polymer anti-seepage wall is formed through the expansion and the rheology of the polymer material, the polymer anti-seepage wall technology is a "minimally invasive" repair technology.

In conclusion, this invention is different from the conventional anti-seepage wall technology whatever through the material, the mechanism or the construction methods, which has the advantages such as speediness, ultra-thinness, minimally invasive, lightness, high toughness, economy, and durability, applied in the reinforcement project of a number of the dams and the dikes, which has huge economic, social benefit and developing application prospect.

These and other objectives, features, and advantages of the present invention will become apparent from the following detailed description, the accompanying drawings, and the appended claims.

DETAILED DESCRIPTION OF THE PREFERRED EMBODIMENT

Figure 1:
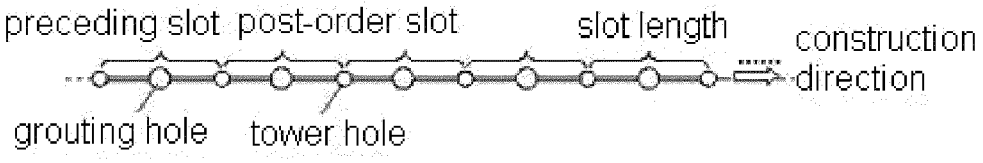
FIG. 1 is a layout diagram of a slot.
Figure 2:
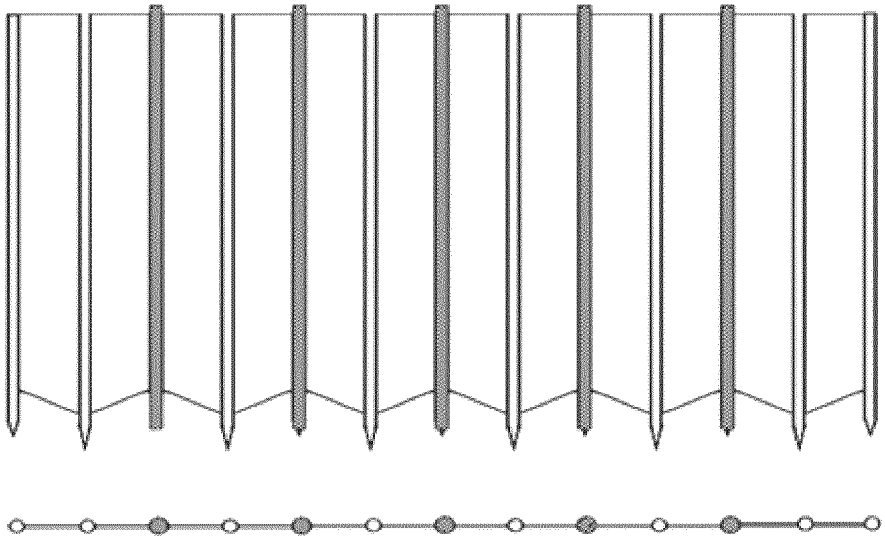
FIG. 2 is a structure diagram of a polymer anti-seepage wall.

The present invention provides a grouting method of an ultra-thin polymer anti-seepage wall meeting requirements of anti-seepage designs of dams, the method comprises the following steps of:

forming slots which are continuous on bodies of the dams and foundations which need seepage-proofing and reinforcing; and injecting two-component expansive polymer grouting materials to the slots through grouting pipes, wherein a volume rapidly expands after the two-component expansive polymer grouting materials reacts and the slots are filled to form polymer ultra-thin bodies, the polymer ultra-thin bodies which are adjacent are cemented together to form a continuous, uniform, and regular cementing ultra-thin polymer anti-seepage wall; specifically, the method comprises the following steps of:

1) arranging the slots: arranging the slots on the bodies of the dams and the foundations which need seepage-proofing and reinforcing according to the anti-seepage design and giving the slots numbers;

2) forming the slots: forming the slots which are continuous by a three cone head pressure slot board or a static press-in equipment, referring to FIG. 1 of the drawings;

3) grouting into the slots, comprising:

c. providing grouting pipes into the slots, wherein each grouting pipe is deeply inserted into each bottom of the slots; and d. injecting the two-component expansive polymer grouting materials into the slots through the grouting pipes, and continuously lifting the grouting pipes, in such a manner that the two-component expansive polymer grouting materials fill up the slots from bottom to top to form an ultra-thin polymer anti-seepage body; and 4) forming the ultra-thin polymer anti-seepage wall, comprising: closely cementing the ultra-thin polymer anti-seepage bodies which are adjacent together by setting the slots and dividing construction regionals to form the continuous, uniform, and closely cementing ultra-thin polymer anti-seepage wall, referring to FIG. 2 of the drawings.

Figure 3:
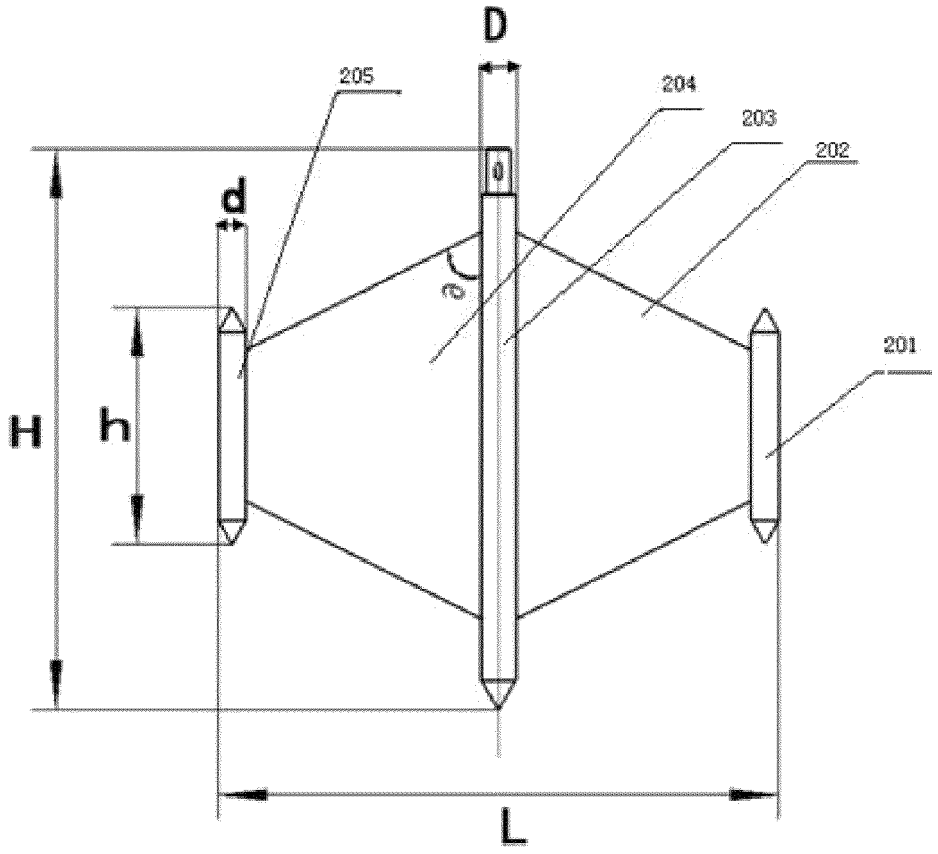
FIG. 3 is a structure diagram of a three cone head pressure slot board.
Figure 4:
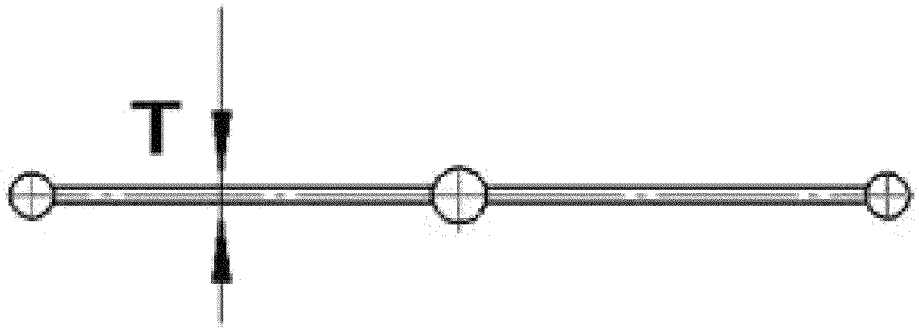
FIG. 4 is a top view of the structure diagram of the three cone head pressure slot board.

In step 2), the three cone head pressure slot board is a double wings three-cone structure, referring to FIG. 3 and FIG. 4, which comprises a middle drill pipe 203, a left drill pipe 205, and a right drill pipe 201, wherein the middle drill pipe 203 is cylindrical, a diameter D is 40~80 cm, a height H is 800~1000 mm, wherein a lower end of the middle drill pipe 203 is tapered, a connector is provided on an upper end, which are connected with the static pressing equipment, wherein a shape and a size of the left drill pipe 205 and the right drill pipe 201 are the same, which are cylindrical, wherein two ends of the left drill pipe 205 and the right drill pipe 201 are both tapered, a diameters d of the left drill pipe 205 and the right drill pipe 201 are 30~40 mm, a height h is 400~600 mm. The left drill pipe 205 is connected with the middle drill pipe 203 through a left-wing board 204, the right drill pipe 201 is connected with the middle drill pipe 203 through a right-wing board 202, the left-wing broad 204 has a same size as the right-wing broad 202, which are equilateral trapezoidal, wherein the left-wing broad 204 and the right-wing broad 202 both are the equilateral trapezoidal sheets that bottoms thereof has edges, a thickness T=10~30 mm, an angle $\alpha$ between the hypotenuse and the edge of the equilateral trapezoidal is 60~70°. The middle drill pipe 203, the left-wing board 204, the right-wing board 202, the left drill pipe 205 and the right drill pipe 201 are at the same horizontal plane, a width L of the three cone head pressure slot board is 500~1200 mm.

Figure 5:
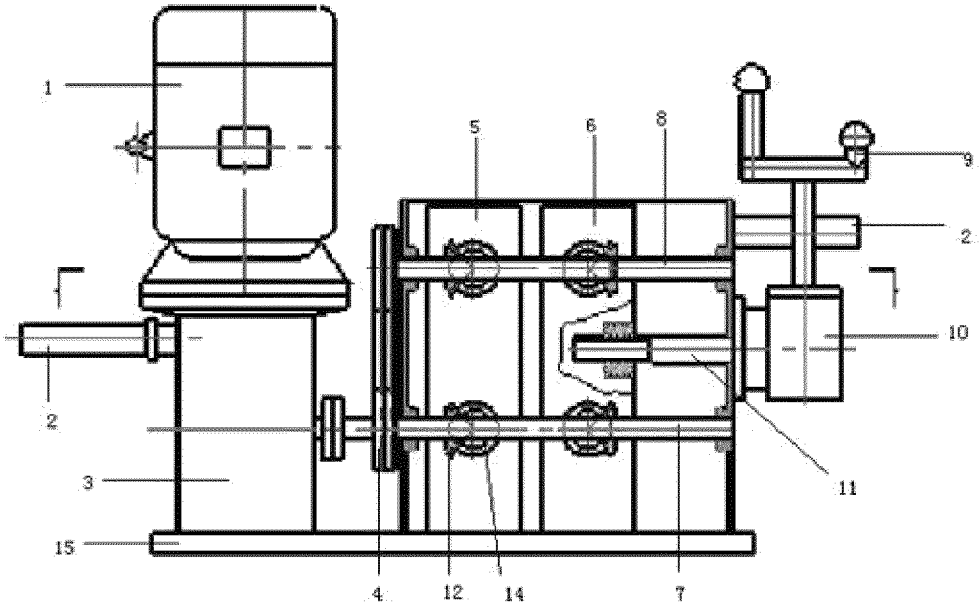
FIG. 5 is a structure diagram of a polymer lifting grouting control equipment.
Figure 6:
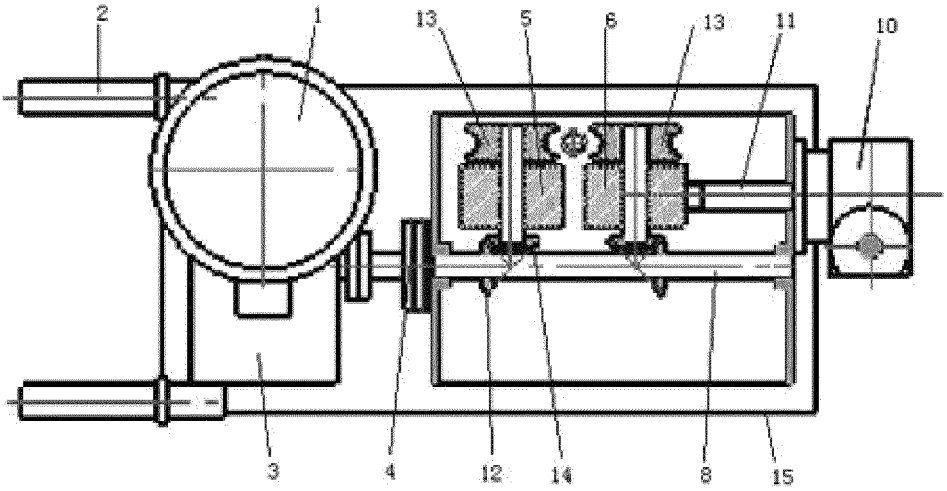
FIG. 6 is an A-A view of the structure diagram of the polymer lifting grouting control equipment.

The slots of the ultra-thin polymer anti-seepage wall are formed by pressing the three cone head pressure slot board into the body of the dam through the static press-in equipment, specifically, a method comprises the following steps of:

arranging the slots: arranging the slots along the anti-seepage wall axle according to the design;

forming a single grouting slot: pressing the three cone head pressure slot board into the body of the dam through the static press-in equipment to form the single grouting slot; and forming continuous slots: the static press-in equipment moves one width along a dam axle, the left drill pipe of the three cone head pressure slot board aims to the circular hole of the slot formed by the right drill pipe according to the previous operation, the static press-in equipment is pressed and pulled out again to form continuous slots. In step 3) b, a polymer lifting grouting control equipment, referring to FIG. 5 and FIG. 6, comprises a rack 15, a first speed reducer 3 provided on the rack, a motor 1 connected with the first speed reducer 3, a main transmission shaft 7 and a minor transmission shaft 8 provided on the rack, wherein the main transmission shaft 7 is connected with the first speed reducer 3, the minor transmission shaft 8 is connected with the main transmission shaft 7 through the transmission chain 4, a left board 5 and a right board 6 provided on the rack, two active driving bevel gears 12 are provided on the main transmission shaft 7 and the minor transmission shaft 8 separately, two passive driving bevel gears 14 are provided on the left board and the right board separately which are meshing with the two active driving bevel gears, a concave gear 13 is provided on the other end of each said passive driving bevel gear, a second reducer 10 is provided on the rash, a cross-handle 9 is connected with the second reducer 10, the right board 6 is connected with the second reducer 10 through the separation screw 11, an armrest 2 is provided on the rack. The passive driving bevel gears connected with the right board are embedded in an inner of two bearings which vertical connected with the right board, the active driving bevel gears meshing with the passive driving bevel gears connected with the right board are connected with the main transmission shaft and the minor transmission shaft by spline grooves and capstans, said spline grooves are provided in the inner of the passive driving bevel gears, said capstans are embedded in the main transmission shaft and the minor transmission shaft to let the right board move left and right by the separation screw 11, the active driving bevel gears are drove by the main transmission shaft 7 and the minor transmission shaft 8 to ensure that the right board 6 and the two active driving bevel gears on the right board 6 are fixed with each other relatively.

The polymer lifting grouting control equipment further comprises a manipulate box connected with the motor, wherein a voltmeter, an ammeter, a frequency converter, and a master switch are provided in the manipulate box. The polymer lifting grouting control equipment is used to switch the power.

The first reducer is matched with the frequency converter to adjust the lifting speeds of the grouting pipe, the reducer is 90 type worm gear reducer.

The second reducer is matched with the cross-handle, rotating the cross-handle again to fix the grouting pipe; the right board is driven to move by the separation screw to separate the left board and the right board, the grouting pipe is provided between the left concave gear and the right concave gear, the grouting pipe lifts through the two concave gears rotating in different direction. The second reducer is 25-typed worm gear reducer.

The working process of the polymer lifting grouting control equipment comprises:

1) disposing the polymer lifting grouting control equipment on the hole which has being inserted with the grouting pipe;
2) rotating the cross-handle to divide the left board from the right board;
3) adjusting a location of the device to provide the grouting pipes between the left concave gears and the right concave gears and at the same plane;
4) rotating the cross-handle again to fix the grouting pipes;
5) turning up 220V AC power and opening the control box to control the lifting speed of the grouting pipe;
6) turning up the device and then the device begins to work, the grouting pipe begins to lift; and
7) turning off the power until the grouting pipe lifts to a required height, rotating the cross-handle to divide the left board from the right board, and moving away the grouting pipe to complete the operation.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A grouting method of an ultra-thin polymer anti-seepage wall, comprising following steps of:

forming slots which are continuous on a body of dam and foundations which need seepage-proofing and reinforcing according to requirements of anti-seepage designs of dams; and injecting two-component expansive polymer grouting materials to the slots through grouting pipes, wherein a volume rapidly expands after the two-component expansive polymer grouting materials reacts and the slots are filled to form a polymer ultra-thin body, the polymer ultra-thin bodies which are adjacent are cemented together to form a continuous, uniform, and regular cementing ultra-thin polymer anti-seepage wall;

wherein specifically, the method comprises following steps of:

1) arranging the slots: arranging the slots on the body of dam and the foundations which need seepage-proofing and reinforcing according to the anti-seepage design and giving the slots numbers;
2) forming the slots, comprising: forming the slots which are continuous by slot equipments;
3) grouting into the slots comprising:
a. providing grouting pipes into the slots, wherein each the grouting pipe is deeply disposed at each bottom of the slots; and
b. injecting the two-component expansive polymer grouting materials into the slots through the grouting pipes, and continuously lifting the grouting pipes, in such a manner that the two-component expansive polymer grouting materials fill up the slots from bottom to top to form an ultra-thin polymer anti-seepage body; and
4) forming the ultra-thin polymer anti-seepage wall, comprising: closely cementing the ultra-thin polymer anti-seepage bodies which are adjacent together by setting the slots and dividing construction regionals to form the continuous, uniform, and closely cementing ultra-thin polymer anti-seepage wall;

wherein in the step 3), a polymer lifting grouting control equipment is used for lifting the grouting pipes, the polymer lifting grouting control equipment comprises a rack, a first speed reducer provided on the rack, a motor connected with the first speed reducer, a main transmission shaft and a minor transmission shaft provided on the rack, wherein the main transmission shaft is connected with the first speed reducer, the minor transmission shaft is connected with the main transmission shaft through a transmission chain, a left board and a right board are provided on the rack, two active driving bevel gears are provided on the main transmission shaft and the minor transmission shaft separately, two passive driving bevel gears are provided on the left board and the right board separately which are meshing with the two active driving bevel gears, and the passive driving bevel gears connected with the right board are embedded in inners of two bearings which are vertically connected with the right board, the active driving bevel gears meshing with the passive driving bevel gears connected with the right board are connected with the main transmission shaft and the minor transmission shaft by spline grooves and capstans, the spline grooves are provided in the inner of the passive driving bevel gears, the capstans are embedded in the main transmission shaft and the minor transmission shaft, a concave gear is provided on each end of the passive driving bevel gears, a second reducer is provided on the rack, a cross-handle is connected with the second reducer, the right board is connected with the second reducer through a separation screw, an armrest is provided on the rack.

2. The grouting method of the ultra-thin polymer anti-seepage wall, as recited in claim 1, wherein the polymer lifting grouting control equipment comprises a manipulate box connected with the motor, wherein a voltmeter, an ammeter, a frequency converter, and a master switch are provided in the manipulate box.

3. A grouting method of an ultra-thin polymer anti-seepage wall, comprising following steps of:

forming slots which are continuous on a body of dam and foundations which need seepage-proofing and reinforcing according to requirements of anti-seepage designs of dams; and injecting two-component expansive polymer grouting materials to the slots through grouting pipes, wherein a volume rapidly expands after the two-component expansive polymer grouting materials reacts and the slots are filled to form a polymer ultra-thin body, the polymer ultra-thin bodies which are adjacent are cemented together to form a continuous, uniform, and regular cementing ultra-thin polymer anti-seepage wall;

wherein specifically, the method comprises following steps of:

1) arranging the slots: arranging the slots on the body of dam and the foundations which need seepage-proofing and reinforcing according to the anti-seepage design and giving the slots numbers;

2) forming the slots, comprising: forming the slots which are continuous by slot equipments;

3) grouting into the slots comprising:

a. providing grouting pipes into the slots, wherein each the grouting pipe is deeply disposed at each bottom of the slots; and b. injecting the two-component expansive polymer grouting materials into the slots through the grouting pipes, and continuously lifting the grouting pipes, in such a manner that the two-component expansive polymer grouting materials fill up the slots from bottom to top to form an ultra-thin polymer anti-seepage body; and 4) forming the ultra-thin polymer anti-seepage wall, comprising: closely cementing the ultra-thin polymer anti-seepage bodies which are adjacent together by setting the slots and dividing construction regionals to form the continuous, uniform, and closely cementing ultra-thin polymer anti-seepage wall.

wherein the slot equipments are three cone head pressure slot board and static press-in equipment, wherein the three cone head pressure slot board comprises a middle drill pipe, a left drill pipe, and a right drill pipe, wherein the left drill pipe has a same size as the right pipe, the left drill pipe is connected with the middle drill pipe through a leftwing board, the right drill pipe is connected with the middle drill pipe through a rightwing board, the left-wing broad has the same size as the right-wing broad, the middle drill pipe, wherein the left-wing board, the right-wing board, the left drill pipe and the right drill pipe are at the same horizontal plane, wherein a below end of the middle drill pipe is tapered, a connector is provided on an up end, wherein two ends of the left drill pipe and the right drill pipe are both tapered.

* * * * *